US011248778B2

(12) United States Patent
Han

(10) Patent No.: US 11,248,778 B2
(45) Date of Patent: Feb. 15, 2022

(54) REINFORCED ELECTRICAL WIRE AND STRING LAMP HAVING REINFORCED ELECTRICAL WIRES

(71) Applicant: Houhua Han, Hubei (CN)

(72) Inventor: Houhua Han, Hubei (CN)

( * ) Notice: Subject to any disclaimer, the term of this patent is extended or adjusted under 35 U.S.C. 154(b) by 0 days.

(21) Appl. No.: 16/543,360

(22) Filed: Aug. 16, 2019

(65) Prior Publication Data

US 2019/0368705 A1 Dec. 5, 2019

Related U.S. Application Data

(63) Continuation-in-part of application No. 15/293,436, filed on Oct. 14, 2016, now Pat. No. 10,473,278.

(30) Foreign Application Priority Data

May 23, 2014 (CN) ..... 201420266522.1

(51) Int. Cl.

| | |
|---|---|
| ***F21V 23/00*** | (2015.01) |
| ***F21V 23/06*** | (2006.01) |
| ***F21S 4/10*** | (2016.01) |
| *F21W 121/04* | (2006.01) |

(52) U.S. Cl.

CPC ..... *F21V 23/001* (2013.01); *F21S 4/10* (2016.01); *F21V 23/06* (2013.01); *F21W 2121/04* (2013.01)

(58) Field of Classification Search

CPC ..... F21V 23/001; F21V 23/06; F21S 4/10

See application file for complete search history.

(56) References Cited

U.S. PATENT DOCUMENTS 6,595,657 B1 * 7/2003 Shieh ..... H01R 33/09 362/448

* cited by examiner

*Primary Examiner* — Thomas M Sember

(57) ABSTRACT

The present invention provides a string lamp including a plurality of lamp bodies connected in series, a plurality of reinforced electrical wires used for connecting two adjacent lamp bodies or connecting the lamp bodies with power connectors; the reinforced electrical wire includes a metal lead wire, a serving enclosing a periphery of the metal lead wire, and a reinforcing device embedded in the serving. A part of the reinforcing device is located in the serving, and the other part of the reinforcing device is exposed at an outside of the serving.

20 Claims, 6 Drawing Sheets

REINFORCED ELECTRICAL WIRE AND STRING LAMP HAVING REINFORCED ELECTRICAL WIRES

This application is a continuation-in-part of the application filed Oct. 14, 2016, application Ser. No. 15/293,436, entitled "Reinforced Electrical Wire and String Lamp Having Reinforced Electrical Wires", which is a continuation-in-part of the application filed May 22, 2015, application Ser. No. 14/720,541, entitled "Single-line String Lamp", which is based upon and claims priority to Chinese Patent Application No. 201420266522.1, filed May 23, 2014, the entire contents of which are incorporated herein by reference.

TECHNICAL FIELD

The present invention relates to the field of electrical wires, and particularly to a reinforced electrical wire and a string lamp having reinforced electrical wires.

BACKGROUND

A string lamp is widely used for indoor or outdoor decoration as a requisite ornament in festival celebration. The string lamp mainly refers to decorative lamps connected in series in an electrical circuit, and typically has an elongated lamp holder for fixing a lamp bulb and a connecting base for achieving electrical connection between the lamp bulb and a lead wire. A plurality of string lamps are connected with one another in series through lead wire segments with metal conductive terminals fixed at two ends. The conductive terminals of these lead wire segments are inserted into the connecting base from the bottom of the connecting base to be electrically connected with lamp pins of the lamp bulb. However, during the use of the string lamp with this structure for decoration, when the lead wire is subjected to lateral tension relative to the connecting base of the string lamp (the lead wire segment between the adjacent lamp holders is straightened perpendicular to an optical axis), some of the conductive terminals are inclined in the connecting base due to the tension, and finally likely to be pulled out from the bottom of the connecting base, resulting in potential safety hazards or extinguishment and failure of the string lamp, which also does not meet the requirements of American safety regulations. In the prior art, a decorative lamp manufacturer adds a false line on the string lamp, and the false line and the lead wire segment are stranded together, when an electrical wire is subjected to lateral tension, the false line can bear most of a tensile force, and the stress on the end of the lead wire segment and the conductive terminals is very low, so that their positions relative to the inner wall of the connecting base are unlikely to change, and they are unlikely to be pulled out from the bottom of the connecting base. However, if the false line and the lead wire segment are not tightly stranded or copper sheets on the conductive terminals are obliquely embedded into the connecting base, when the electrical wire is subjected to tension, some of the conductive terminals can also be pulled out, resulting in potential safety hazards, and also the beauty and the service life are influenced.

SUMMARY OF THE INVENTION

In view of this, the technical problem to be solved in the present invention is to provide an integrated anti-tensile reinforced electrical wire.

In order to solve the above technical problem, the technical solution provided by the present invention is as follows: a reinforced electrical wire includes a metal lead wire and a serving enclosing the periphery of the metal lead wire, a reinforcing device is embedded in the serving, a part of the reinforcing device is located in the serving, and the other part of the reinforcing device is exposed at the outside of the serving.

Compared with the prior art, the present invention has the following advantages:

The reinforced electrical wire provided by the present invention is simple and stable in structure, high in safety, beautiful, convenient to install and use and long in service life. The production process thereof, in combination with various components, is simple and efficient.

DETAILED DESCRIPTION

For the convenient understanding of those skilled in the art, the present invention will be further described below in detail in combination with the accompanying drawings and embodiments.

The present invention provides a reinforced electrical wire including a metal lead wire, a serving enclosing the periphery of the metal lead wire, and a reinforcing device. The reinforcing device is embedded in the serving, a part of the reinforcing device is located in the serving, and the other part of the reinforcing device is exposed at the outside of the serving. Or, the whole reinforcing device is embedded in the serving, and a material of the reinforcing device is different from that of the serving. In one embodiment, the reinforcing device is a plastic strip. The reinforcing device is internally provided with a plastic wire. The reinforcing device is selected from a polyethylene wire, a nylon wire, a carbon wire, a braided wire and a combination thereof. The reinforcing devices include one or more such devices and are uniformly distributed on the surface of the serving; and the section of the reinforcing device is a circle, a square or any geometrical shape. The reinforcing devices are vertically embedded in the serving in parallel or annularly twined on the serving. The reinforcing device and the plastic serving are integrally formed by the same material. The toughness and elongation of the reinforcing device are higher than those of the serving; and the toughness and elongation of the plastic wire are higher than those of the reinforcing device, and the plastic wire is composed of polymer chemical fibers that are interconnected or arranged in line.

The metal lead wires and the reinforcing device are arranged in parallel lines, are conveyed into the body of an electrical wire extruder and are formed by extruding the serving material by the extruder, and the reinforcing device, the metal lead wires and the serving are extruded into a whole reinforced electrical wire by the extrusion of the extruder. The metal lead wires are independent, the reinforcing device and the serving are respectively loaded together by a transverse H-shaped metal disk bracket, and the reinforcing device and the metal lead wires are conveyed into the electrical wire extruder in one line or upper and lower lines to be formed by extrusion.

In one embodiment, the reinforced electrical wire is a UL conventional electrical line No. 22 or No. 20. In another embodiment, the reinforced electrical wire is a non-conventional electrical line with a diameter of 1.2-3.0 mm.

Embodiment 1

Figure 1:
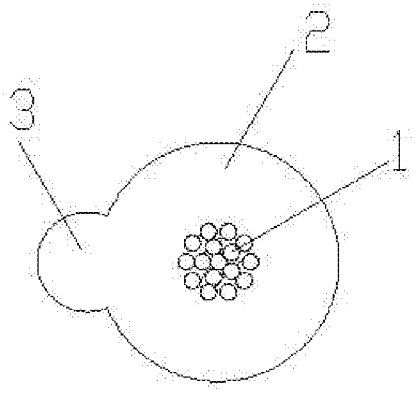
FIG. 1 is a schematic diagram of a section structure of an embodiment 1 of the present invention.
Figure 5:
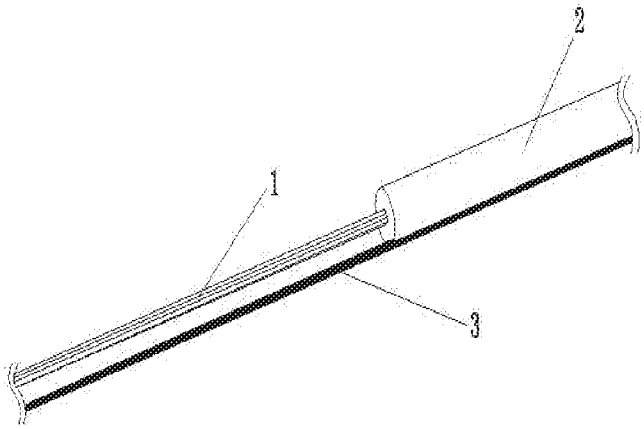
FIG. 5 is a structural diagram of the present invention.

As shown in FIGS. 1 and 5, a reinforced electrical wire includes a metal lead wire 1 and a serving 2 (or plastic coating) enclosing the periphery of the metal lead wire 1, a reinforcing device is embedded in the serving, a part of the reinforcing device is in the serving, and the other part of the reinforcing device is exposed at the outside of the serving. The reinforcing device is a plastic strip 3 in the embodiment. In the embodiment, one plastic strip is provided, the plastic strip is vertically embedded in the serving in parallel (the plastic strip can also be annularly twined on the serving), the plastic strip 3 and the serving 2 are made from the same material, namely can be integrally formed, and the section of the plastic strip is a circle, a square or any geometrical shape.

The production process of the reinforced electrical wire is as follows: the metal lead wire is independent, is loaded together by the existing transverse H-shaped metal disk bracket and is conveyed into the body of an electrical wire extruder, a serving material and the plastic strip that is embedded in the serving and is integrally formed with the serving are extruded by the extruder, and the plastic strip, the metal lead wire and the serving are extruded into an entirety by the extrusion of the extruder. The extruder is the existing electrical wire extruder on the market, the working conditions and temperature are the same as those of the machine on the market, and the production process of the integrated anti-tensile reinforced electrical wire with the integrated plastic strip adopts the existing electrical wire production conditions as the production process. For example, plastic is melted and extruded at segmented temperatures from low to high to be formed. The serving of the electrical wire is made from materials of the existing electrical wire. For example, the material is PVC and other corresponding chemical substances that are mixed together. The plastic strip can be made from such high-performance materials as polyethylene wires, nylon wires, carbon wires and braided wires, etc.

In the embodiment, one or more plastic strips can also be equidistantly or non-equidistantly arranged on the serving.

Embodiment 2

Figure 2A:
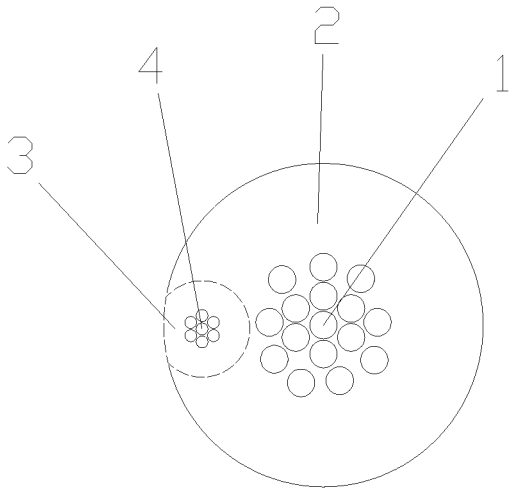
FIG. 2*a* is a schematic diagram of a section structure of an embodiment 2 of the present invention.
Figure 2B:
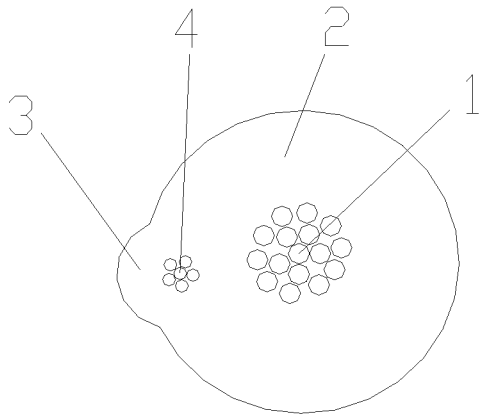
FIG. 2*b* is another schematic diagram of a section structure of the embodiment 2 of the present invention.

As shown in FIG. 2*a* and FIG. 2*b*, the difference from embodiment 1 lies in that the reinforcing device of the embodiment is internally provided with a plastic wire 4.

The production process of the reinforced electrical wire is as follows: the metal lead wire 1 and the plastic wire 4 are arranged in parallel and are conveyed into the body of the electrical wire extruder, the serving material and the plastic strip 3 that is embedded in the serving 2 and is integrally formed with the serving are extruded by the extruder, and the plastic strip, the metal lead wire and the serving are extruded into an entirety by the extrusion of the extruder. The extruder is the existing electrical wire extruder on the market, the working conditions and temperature are the same as those of the machine on the market, and the production process of the integrated anti-tensile reinforced electrical wire with the integrated plastic strip adopts the existing electrical wire production conditions as the production process. For example, plastic is melted and extruded at segmented temperatures from low to high to be formed. The serving of the electrical wire is made from materials of the existing electrical wire. For example, the material is PVC and other corresponding chemical substances that are mixed together. The metal lead wire is independent and is loaded together by the existing transverse H-shaped metal disk bracket, the plastic strip is still loaded in this way, and the metal lead wire and the plastic strip are conveyed into the electrical wire extruder in one line or upper and lower lines to be formed by extrusion.

In the embodiment, one or more plastic strips can also be equidistantly or non-equidistantly arranged on the serving.

Embodiment 3

Figure 3A:
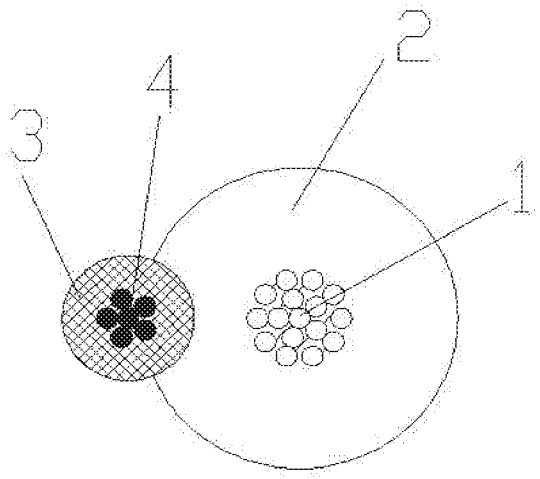
FIG. 3*a* is a schematic diagram of a section structure of an embodiment 3 of the present invention.
Figure 3B:
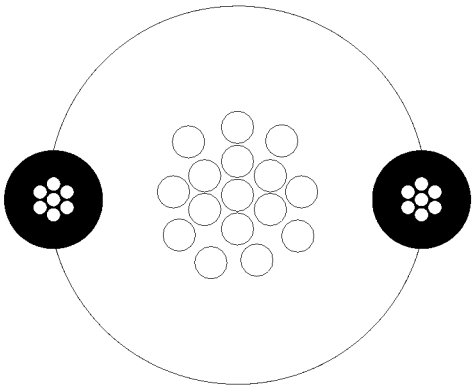
FIG. 3*b* is a schematic diagram of a section structure provided with two plastic strips of the embodiment 3 of the present invention.
Figure 3C:
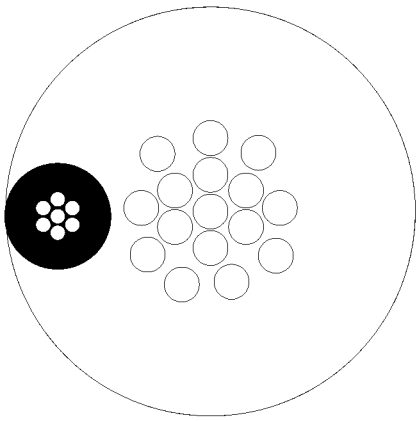
FIG. 3*c* is another schematic diagram of a section structure provided with one plastic strip of the embodiment 3 of the present invention, the plastic strip being embedded in the serving.

As shown in FIGS. 3*a* to 3*c*, the difference from embodiment 2 lies in that the plastic strip of the embodiment is made from a polyethylene high-performance material and is preferably made from one of nylon wires, carbon wires and braided wires, and the toughness and elongation of the material of the plastic strip are higher than those of the serving, and the plastic strip can bear a 10-30 KG tensile test. The toughness and elongation of the plastic wire are higher than those of the plastic strip, and the plastic wire is composed of polymer chemical fibers that are interconnected or arranged in line. Specifically, as shown in FIG. 3*c*, the whole reinforcing device is embedded in the serving, and a material of the reinforcing device is different from that of the serving.

The production process of the reinforced electrical wire is as follows: the plastic strip internally provided with the plastic wire is made at first, the plastic wire is wrapped with the plastic strip material through the extruder to be formed, then the metal lead wire and the plastic strip internally provided with the plastic wire are arranged in parallel, are conveyed into the body of the electrical wire extruder and are formed by extruding the serving material by the extruder, and the plastic strip, the metal lead wire and the serving are extruded into an entirety by the extrusion of the extruder. The extruder is the existing electrical wire extruder on the market, the working conditions and temperature are the same as those of the machine on the market, and the production process of the integrated anti-tensile reinforced electrical wire with the integrated plastic strip adopts the existing electrical wire production conditions as the production process. For example, plastic is melted and extruded at segmented temperatures from low to high to be formed. The serving of the electrical wire is made from materials of the existing electrical wire. For example, the material is PVC and other corresponding chemical substances that are mixed together. The metal lead wire is independent and is loaded together by the existing transverse H-shaped metal disk bracket, the plastic strip is still loaded in this way, and the metal lead wire and the plastic strip are conveyed into the electrical wire extruder in one line or upper and lower lines to be formed by extrusion. The plastic of the electrical wire adopts a raw material body different from all existing plastic raw materials.

As shown in FIG. 3*b*, one or more plastic strips can also be equidistantly or non-equidistantly arranged on the serving.

Embodiment 4

The difference from embodiment 1 lies in that the plastic strip of the embodiment is made from a polyethylene high-performance material and is preferably made from one of nylon wires, carbon wires and braided wires, and the toughness and elongation of the material of the plastic strip are higher than those of the serving, and the plastic strip can bear a 10-30 KG tensile test.

The production process of the reinforced electrical wire is as follows: the plastic strip internally provided with the plastic wire is made at first, the plastic wire is wrapped with the plastic strip material by the extruder to be formed, then the metal lead wire and the plastic strip internally provided with the plastic wire are arranged in parallel, are conveyed into the body of the electrical wire extruder and are formed by extruding the serving material by the extruder, and the plastic strip, the metal lead wire and the serving are extruded into an entirety by the extrusion of the extruder. The extruder is the existing electrical wire extruder on the market, the working conditions and temperature are the same as those of the machine on the market, and the production process of the integrated anti-tensile reinforced electrical wire with the integrated plastic strip adopts the existing electrical wire production conditions as the production process. For example, plastic is melted and extruded at segmented temperatures from low to high to be formed. The serving of the electrical wire is made from all materials of the existing electrical wire. For example, the material is PVC and other corresponding chemical substances that are mixed together. The metal lead wire is independent and is loaded together by the existing transverse H-shaped metal disk bracket, the plastic strip is still loaded in this way, and the metal lead wire and the plastic strip are conveyed into the electrical wire extruder in one line or upper and lower lines to be formed by extrusion. The plastic of the electrical wire adopts a raw material body different from all existing plastic raw materials.

Figure 4A:
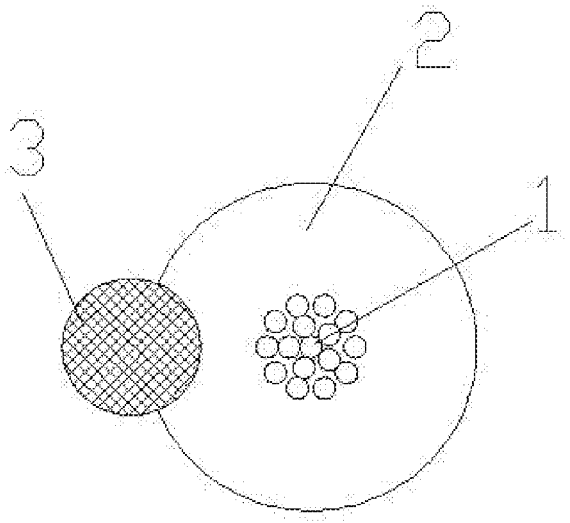
FIG. 4*a* is a schematic diagram of a section structure of an embodiment 4 of the present invention.
Figure 4B:
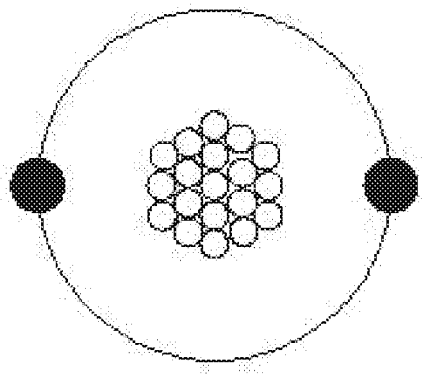
FIG. 4*b* is a schematic diagram of a section structure provided with two plastic strips of the embodiment 4 of the present invention.
Figure 4C:
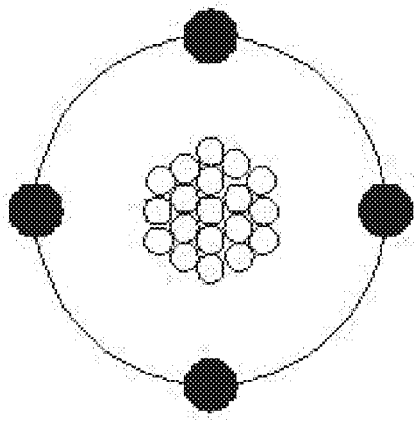
FIG. 4*c* is a schematic diagram of a section structure provided with four plastic strips of the embodiment 4 of the present invention.

As shown in FIGS. 4*a*, 4*b* and 4*c*, one or more plastic strips can also be equidistantly or non-equidistantly arranged on the serving.

Figure 6:
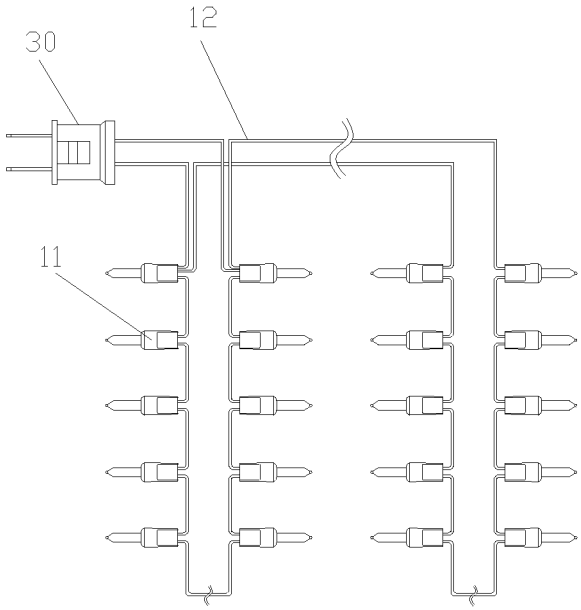
FIG. 6 is a structural diagram of a string lamp having reinforced electrical wires of the present invention.
Figure 7:
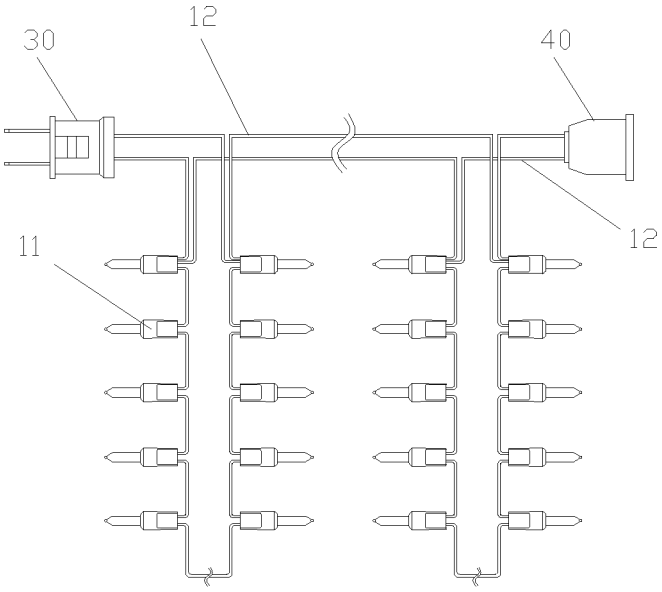
FIG. 7 is a structural diagram of another string lamp having reinforced electrical wires of the present invention.

The present invention also provides a string lamp having reinforced electrical wires. The string lamp having reinforced electrical wires mainly includes a plurality of lamp bodies 11 connected in series and a plurality of reinforced electrical wires 12 used for connecting two adjacent lamp bodies or connecting the lamp bodies with power connectors, and may also include a power module. As shown in FIG. 6, each string lamp is provided with a power plug 30 for an external power source, and the power plug 30 is connected with the leading portion and the trailing portion of the string lamp respectively, so as to supply power to the string lamp. It can be seen clearly, every two lamp bodies are connected by only one reinforced electrical wire segment, without arranging a false line to form a double-stranded line. A conductive element is fixed at the end of the reinforced electrical wire segment that is connected with the lamp body, that is to say, a conductive element is fixed at either end of each reinforced electrical wire segment connected between two lamp bodies. And for the reinforced electrical wire segment that connects the lamp body and the power connector, only the end connected to the lamp body is provided with a conductive element. As shown in FIG. 7, each string lamp is provided with a power plug 30 for an external power source and a tail socket 40 for connecting another power plug.

In order to reinforce the stability of the string lamp, generally the string lamp can be mainly arranged on the supports of Christmas trees, Christmas canes or Christmas wreath branches and leaves, and the electrical line used in the lead wire segment connected to each lamp body can be fixed on the corresponding branches and supports in a winding or plastic clamping manner.

To sum up, when the string lamp of the present invention is subjected to a lateral tensile force, the conductive element will not be separated from the opening at the bottom of the connecting base, so as to ensure the normal operation of the string lamp. Therefore, only one reinforced electrical wire segment is needed for the connection between the lamp bodies, without arranging a false line to bear most of lateral tension.

Although the present invention has been described in conjunction with specific embodiments thereof, it is evident that many alternatives, modifications and variations will be apparent to those skilled in the art. All such substitutes, modifications and changes are deemed to be within the spirit and scope of the present invention as it is set out in the following claims.

What is claimed is:

1. A string lamp comprising:

a plurality of lamp bodies connected in series;

a plurality of reinforced electrical wires used for connecting two adjacent lamp bodies or connecting the lamp bodies with power connectors; each reinforced electrical wire comprising:

a metal lead wire;

a serving enclosing a periphery of the metal lead wire; and a reinforcing device embedded in the serving, wherein the reinforcing device, the metal lead wire and the serving are extruded into an entirety by the extrusion of the extruder, wherein a part of the reinforcing device is located in the serving, and other part of the reinforcing device is exposed at an outside of the serving, or the whole reinforcing device is embedded in the serving, and a material of the reinforcing device is different from that of the serving, and the reinforcing device is integrally formed with the serving, wherein the reinforcing device is internally provided with at least one plastic wire, and wherein toughness and elongation of the reinforcing device are higher than those of the serving; and toughness and elongation of the plastic wire are higher than those of the reinforcing device, and the plastic wire is composed of polymer chemical fibers that are interconnected or arranged in line.

2. The string lamp according to claim 1, wherein the reinforcing device is at least one plastic strip.

3. The string lamp according to claim 1, wherein the reinforcing device is selected from a polyethylene wire, a nylon wire, a carbon wire, a braided wire and a combination thereof.

4. The string lamp according to claim 1, wherein the reinforcing device is uniformly distributed on a surface of the serving; and a section of the reinforcing device is a circle, a square or other geometrical shape.

5. The string lamp according to claim 1, wherein the reinforcing devices are vertically embedded in the serving in parallel or annularly twined on the serving.

6. The string lamp according to claim 1, wherein the reinforcing device and the serving are integrally formed by a same material.

7. The string lamp according to claim 1, wherein the reinforced electrical wire is a UL conventional electrical line No. 22 or No. 20.

8. The string lamp according to claim 1, wherein the reinforced electrical wire is a non-conventional electrical line with a diameter of 1.2-3.0 mm.

9. A string lamp comprising:

a plurality of lamp bodies connected in series;

a plurality of reinforced electrical wires used for connecting two adjacent lamp bodies or connecting the lamp bodies with power connectors; each reinforced electrical wire comprising:

a metal lead wire;

a serving enclosing a periphery of the metal lead wire; and a reinforcing device embedded in the serving and integrally formed with the serving, wherein the reinforcing device, the metal lead wire and the serving are extruded into an entirety by the extrusion of the extruder, wherein a part of the reinforcing device is embedded in the serving, and other part of the reinforcing device is exposed at an outside of the serving, or wherein the whole reinforcing device is embedded in the serving, and wherein a material of the reinforcing device is different from that of the serving.

10. The string lamp according to claim 9, wherein the reinforcing device is at least one plastic strip.

11. The string lamp according to claim 9, wherein the reinforcing device is internally provided with at least one plastic wire.

12. The string lamp according to claim 11, wherein toughness and elongation of the reinforcing device are higher than those of the serving; and toughness and elongation of the plastic wire are higher than those of the reinforcing device, and the plastic wire is composed of polymer chemical fibers that are interconnected or arranged in line.

13. The string lamp according to claim 9, wherein the reinforcing device is selected from a polyethylene wire, a nylon wire, a carbon wire, a braided wire and a combination thereof.

14. The string lamp according to claim 9, wherein the reinforcing device is uniformly distributed on a surface of the serving; and a section of the reinforcing device is a circle, a square or other geometrical shape.

15. The string lamp according to claim 9, wherein the reinforcing devices are vertically embedded in the serving in parallel or annularly twined on the serving.

16. The string lamp according to claim 9, wherein the reinforcing device and the serving are integrally formed by a same material.

17. The string lamp according to claim 9, wherein the reinforced electrical wire is a UL conventional electrical line No. 22 or No. 20, or the reinforced electrical wire is a non-conventional electrical line with a diameter of 1.2-3.0 mm.

18. A string lamp comprising:

a plurality of lamp bodies connected in series;

a plurality of reinforced electrical wires used for connecting two adjacent lamp bodies or connecting the lamp bodies with power connectors; each reinforced electrical wire comprising:

a metal lead wire;

a serving enclosing a periphery of the metal lead wire; and a reinforcing device embedded in the serving and integrally formed with the serving, wherein the reinforcing device, the metal lead wire and the serving are extruded into an entirety by the extrusion of the extruder, wherein a part of the reinforcing device is located in the serving, and other part of the reinforcing device is exposed at an outside of the serving, and wherein the reinforcing device is internally provided with at least one plastic wire.

19. The string lamp according to claim 18, wherein the reinforcing device is integrally formed with the serving by a same material.

20. The string lamp according to claim 18, wherein toughness and elongation of the reinforcing device are higher than those of the serving; and toughness and elongation of the plastic wire are higher than those of the reinforcing device, and the plastic wire is composed of polymer chemical fibers that are interconnected or arranged in line.

* * * * *